United States Patent [19]

Robinson

[11] Patent Number: 4,522,543

[45] Date of Patent: Jun. 11, 1985

[54] DEVICE FOR FEEDING INVALIDS

[75] Inventor: Eric Robinson, Manchester, N.H.

[73] Assignee: Robert Rigoli, Norfolk, Mass.

[21] Appl. No.: 572,846

[22] Filed: Jan. 23, 1984

[51] Int. Cl.[3] ..... A47G 21/08

[52] U.S. Cl. ..... 414/9; 74/47; 222/342; 222/357; 222/358; 414/728; 901/14

[58] Field of Search ..... 414/9, 680, 718, 728; 74/45, 46, 47, 102; 222/342, 356, 357, 358; 901/13, 14, 18, 23, 24

[56] References Cited

U.S. PATENT DOCUMENTS

| | | | |
|---|---|---|---|
| 1,333,208 | 3/1920 | Maguire | 414/9 |
| 2,686,408 | 8/1954 | Walker | 414/9 |
| 3,178,040 | 4/1965 | Nelson | 414/728 |
| 3,383,020 | 5/1968 | Cargile | 222/357 X |
| 3,734,306 | 5/1973 | Morewood | 414/9 |
| 4,277,213 | 7/1981 | Morewood | 414/9 |
| 4,309,837 | 1/1982 | Raymond | 74/50 X |
| 4,433,950 | 2/1984 | Hanger et al. | 414/9 |

*Primary Examiner*—Leslie J. Paperner

*Attorney, Agent, or Firm*—Gammons, Robert T.

[57] ABSTRACT

Apparatus for use in feeding physically incapacited persons comprising a spoon supported for orbital and rectilinear movement in a predetermined path, one or more receptacles, and kinematics selectively operable to move a selected receptacle into the path of movement of the spoon and for effecting orbital and rectilinear movement of the spoon from an at-rest position above the receptacle into the receptacle to pick up a quantity of food therefrom, remove it from the receptacle to a position to be received by the person and then return it to its at-rest position in readiness for a repeat cycle of operation.

19 Claims, 9 Drawing Figures

DEVICE FOR FEEDING INVALIDS

BACKGROUND OF THE INVENTION

Apparatus for feeding invalids physically incapable of self-help take various forms as shown in U.S. Pat. Nos. 3,317,661; 3,734,306; 3,907,126; 4,218,167; 4,277,263; and 4,162,868. The apparatus shown in the aforesaid patents are quite complicated and although supposedly do not require the aid of an assistant, have in common the disadvantage that food is spilled during its transfer from the receptacle containing the food to the invalid's mouth with the result that the apparatus, and the area in the immediate vicinity of the apparatus and the invalid recipient of the food becomes spattered with spilled food which is quite unpleasant and distressing to the invalid recipient and creates extra work for the attendants. It is a purpose of this invention to provide a feeding apparatus of relatively simple construction which can be controlled with minimal skill on the part of the invalid to transport food from the receptacle containing the food without spilling and, hence, without waste of food, an apparatus which is selectively operable to permit a free choice of food and an apparatus which can be selectively cycled or automated by the invalid or attendant.

SUMMARY OF THE INVENTION

As herein illustrated, the apparatus comprises, in combination, a spoon for presenting a portion of food to an invalid, a receptacle for containing food and mechanism for effecting orbital and rectilinear movement of the spoon in a vertical plane from an at-rest position above the receptacle downwardly into the receptacle along an arcuate path such that the spoon is plunged into the receptacle to pick up a quantity of food, raised from the receptacle to a generally horizontal position, moved from the receptacle to the invalid's mouth to present the food contained therein to the invalid and, finally, returned to its initial at-rest position. A plow movable in orbit with the spoon provides for heaping food as a preparatory move for the next spoonful as the spoon moves along said arcuate path within the receptacle. The receptacle is provided with an opening through which the spoon is moved to present food to the invalid recipient configured to strip excess food from the spoon before it leaves the receptacle. Desirably, a scraper is located within the receptacle in line with the opening to strip at least some of the food from the spoon before it reaches the opening to gravitationally return excess food to the receptacle. There is a carriage for mounting two or more receptacles for movement transversely of the path of movement of the spoon and means for selectively moving the carriage to present a selected receptacle to the spoon. The receptacles are removably mounted to the carriage. The means for effecting orbital and rectilinear movement of the spoon comprises a rocker mounted intermediate its ends on a trunion block for oscillation and for rectilinear reciprocation, a traverse rod reciprocally mounted to the rocker bar for rectilinear reciprocation relative to the rocker, a motor-driven disk to which an end of the rocker bar is connected and by means of which the rocker bar is oscillated and reciprocated, a rack connected to the traverse bar and a motor-drivien pinion in engagement with the rack for effecting rectilinear reciprocation thereof. There is circuitry for supplying power to the motor and switches for initiating and terminating a cycle of operation and/or for automating the cycle of operation. There is also circuitry and a motor for effecting transverse movement of the carriage and means for initiating and terminating operation of the motor.

The invention will now be described with reference to the accompanying drawings, wherein.

Figure 7:
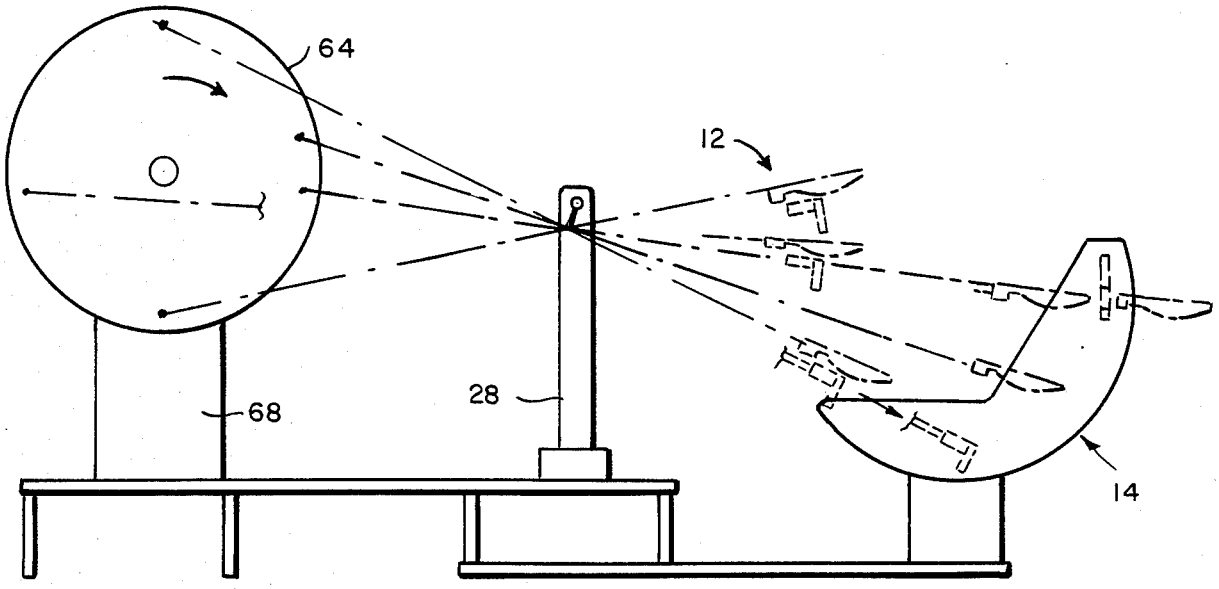

FIG. 7 diagrammatically illustrates the orbital and rectilinear path of movement of the spoon.

Figures 1, 1A, 1B:
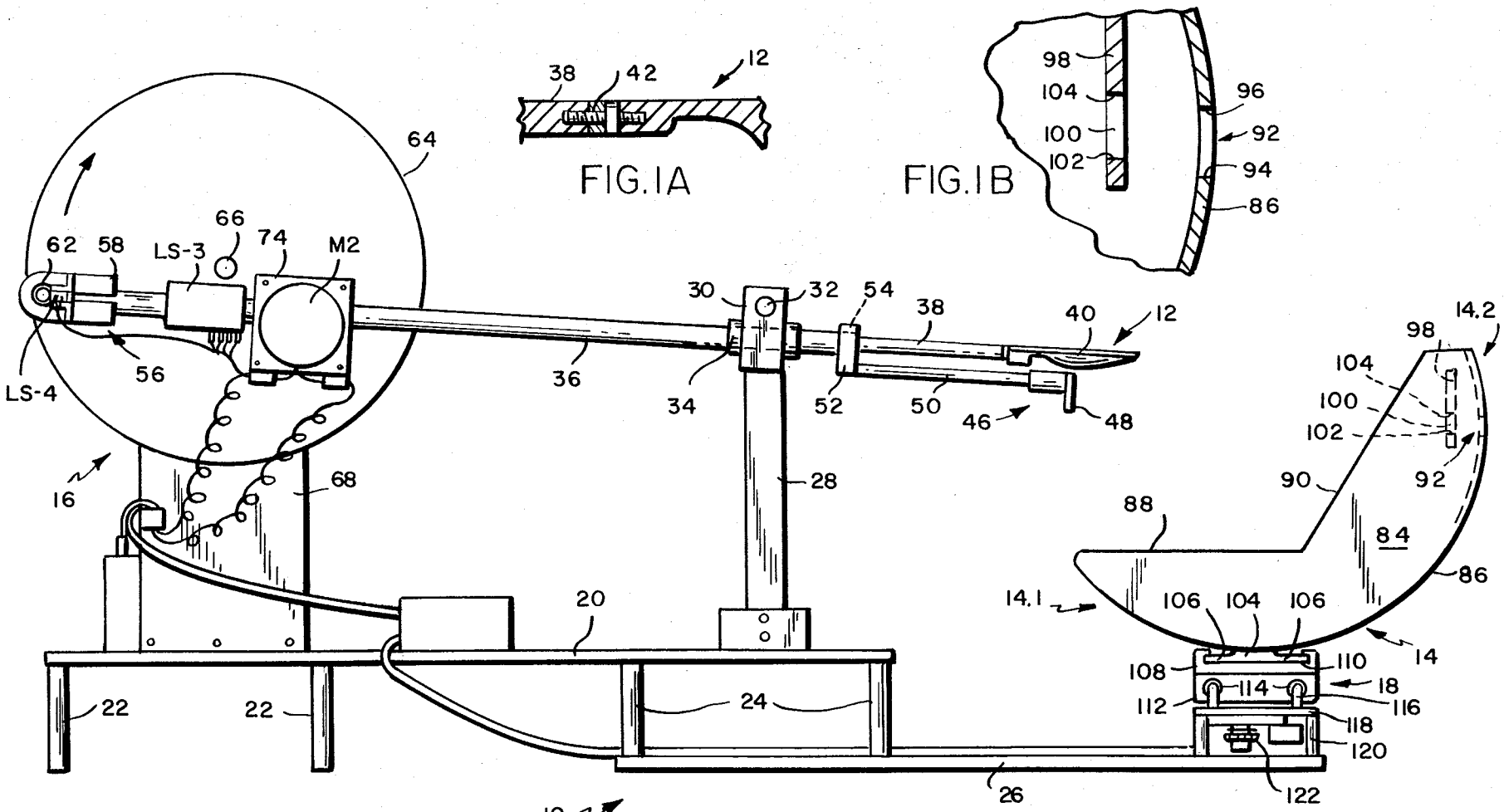
FIG. 1 is a side elevation of the invalid feeding apparatus showing the spoon in a retracted, at-rest position.
FIG. 1A is a fragmentary section of the means for detachably connecting the spoon to the traversing rod.
FIG. 1B is a fragmentary section of the receptable showing the opening through which the spoon is projected and the scraper plate.
Figure 2:
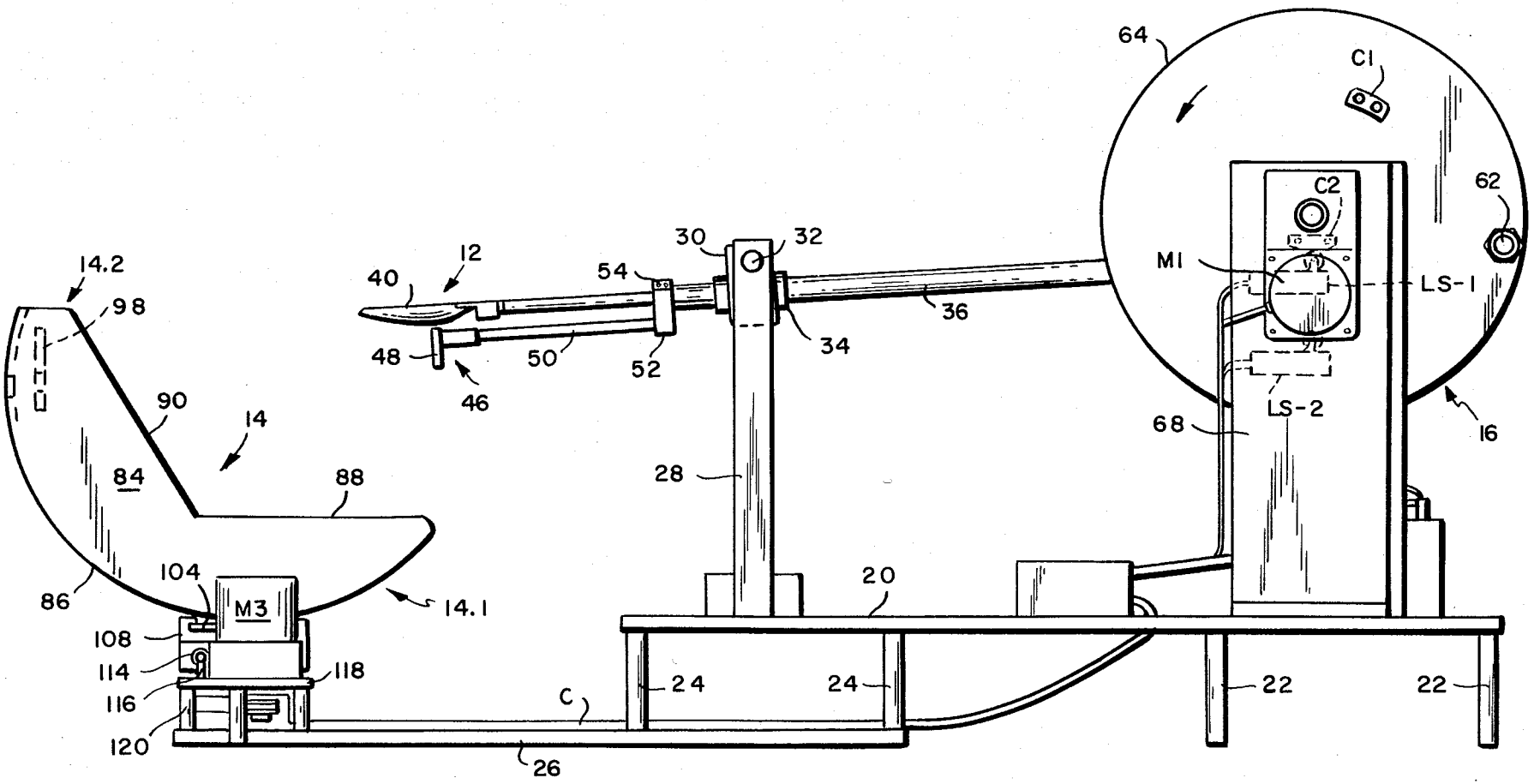
FIG. 2 is an elevation from the opposite side of that shown in FIG. 1.

Referring to the drawings, FIGS. 1 and 2, there is shown a fabricated supporting structure 10 which supports a feeding spoon 12 and one or more receptacles 14, together with power driven means 16 for effecting orbital and rectilinear movement of the spoon to cause it to move into a receptacle 14, retrieve food therefrom and present it to the mouth of the invalid and power-driven means 18 for traversing the receptacles 14 relative to the spoon to present receptacles containing different foods to the spoon.

The supporting structure 10 comprises in part a horizontal rigid bar 20 mounted on vertically-positioned legs 22 at its rear end and legs 24 at its forward end. The legs 24 at the forward end are fixed at their lower ends to a second rigid bar 26, a portion of which underlies the bar 20 and the remainder of which extends forwardly therefrom.

At the forward end of the bar 20, there is fixed a vertically-disposed post 28, at the upper end of which there is mounted a trunion block 30 for rotation about the horizontal axis of a pin 32 fixed to the upper end of the post 28. The trunion block 30 contains a bearing sleeve 34 within which there is slidably mounted a rigid rocker 36 in the form of a sleeve with one end extending forwardly through the bearing sleeve 34 and the other end extending rearwardly through the bearing sleeve 34. The rocker 36 is slidable rectilinearly of the bearing sleeve 34 and is oscillatable relative to the axis of the pin 32. A traverse rod 38 is slidably mounted in the rocker sleeve so as to extend from its forward end and the spoon 12 is detachably fixed to its distal end by a threaded coupling 42, FIG. 1A. A plow 46 is mounted to the forward end of the rocker sleeve in a vertical position below and transversely of the bowl 40 of the spoon at the forward end of a rod 50, the rear end of which is fixed to a collar 52 which is detachably clamped to the rocker by means of screws 54. The plow 48 is of greater transverse width than the spoon and as will appear hereinafter corresponds substantially in transverse width to the width of the receptacles through which the spoon is to be moved. The rocker 36 has fixed to its rear end an L-shaped block 56, FIG. 3, comprising an arm 58 clamped to the rocker and an arm 60 pivotally connected by a pivot pin 62 to one face of a drive disk 64 such that rotation of the drive disk 64 will oscillate the rocker 36 relative to the axis of the pin 32. The drive disk 64 is connected by means of a hub 72 to the drive shaft 66 of an electric motor M1 mounted to the upper end of the post 68, FIG. 2. Rotation of the drive disk 64 will effect oscillation and rectiliner movement.

Figure 3:
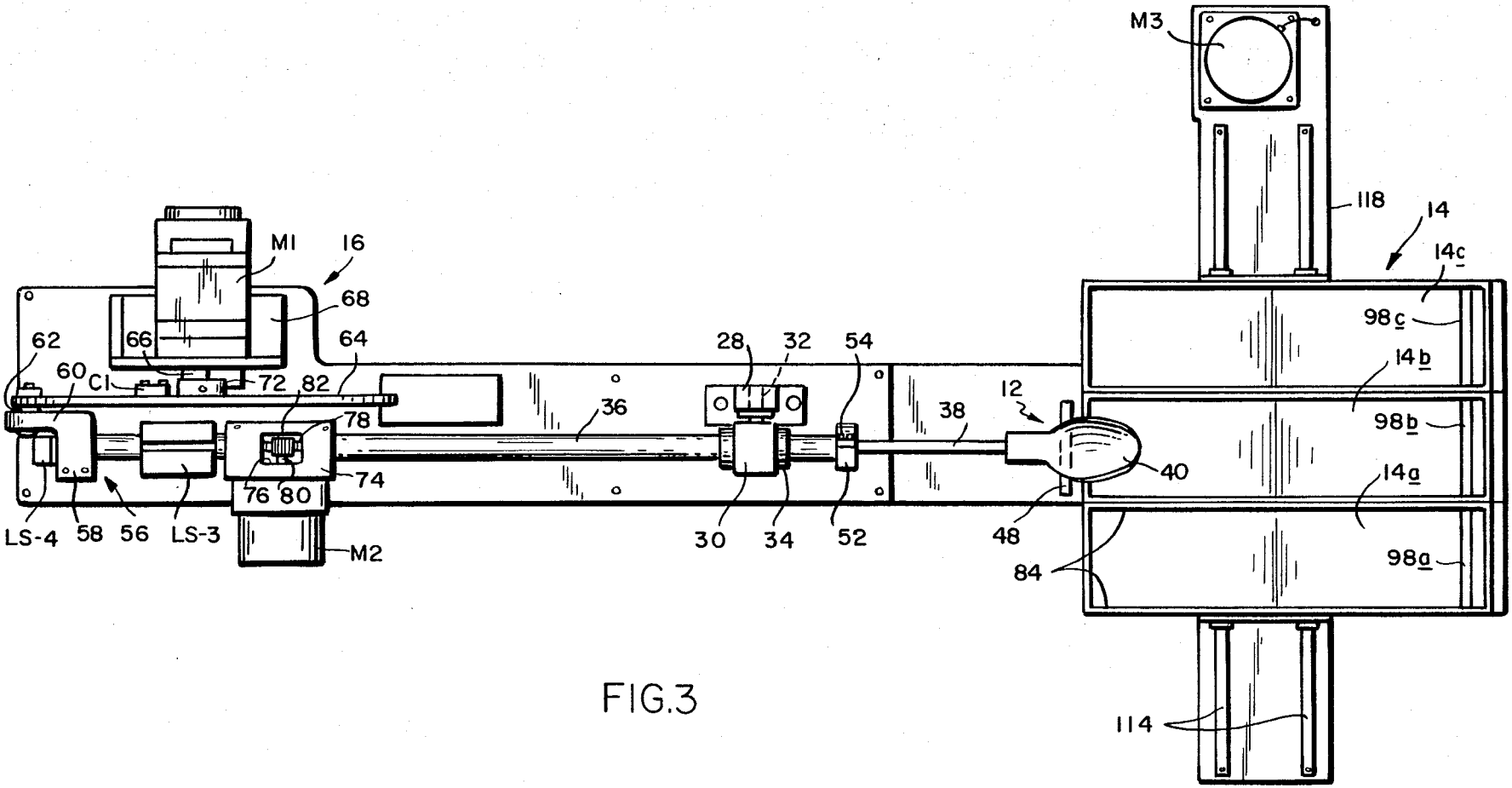
FIG. 3 is a plan view.

A block 74 is fixed to the rocker over an upwardly-facing opening 76, FIG. 3, therein. The block 74, in turn, has an opening 78 in registration with the opening 76. A motor M2 is mounted to the block 74 with its drive shaft 80 extending through the side of the block 74 into the opening 76 and has fixed to it a gear 82 which meshes with a rack 78 attached to or fixed to the traverse rod 38. The motor M2 will thus drive the traverse rod 38 and, hence, the spoon in rectilinear reciprocation by way of the rack and pinion.

From the foregoing, it is apparaent that the spoon 12 can be rocked relative to the axis of the pivot pin 32 and can be moved rectilinearly with respect to the rocker 36. The path of orbital and rectilinear movement of the spoon is diagrammatically illustrated in FIG. 7 and will be described with reference to its function in removing food from the receptacle and presenting it to an invalid in greater detail hereinafter.

One or more receptables hereinafter referred to as trays 14, for example, 14*a*, 14*b* and 14*c*, FIG. 3, may be used, although it is to be understood that there is no limitation as to the number of trays. Each tray 14 has spaced, parallel side walls 84-84 and an arcuate bottom wall 86, FIG. 1. The lower edges of the side wall 84-84 correspond in arcuate configuration to the arcuate bottom wall 86. The upper edges are defined by horizontal edges 88-88 and upwardly-sloping edges 90-90. Each tray, in effect, constitutes a lower trough portion 14.1 for receiving food through which the spoon and plow are moved, as will subsequently appear, to pick up a quantity of food and an upper stripping and retaining portion 14.2 for removing excess food from the spoon before the latter is presented to the recipient. The orbital path of movement of the spoon is such that the bowl of the spoon descends from the at-rest position above the tray, shown in FIGS. 1 and 2, downwardly into the tray at the rear side thereof, FIG. 7, with respect to the forward movement of the spoon, along the arcuately curved bottom of the lower trough portion 14.1 and upwardly into the stripping and retaining portion 14.2 so as to lift a quantity of food from the trough into the stripping and retaining portion. The plow 48 assists in moving food back into the path where the spoon has traveled, in preparation for the next cycle. There is an aperture 92, FIG. 1B, in the retaining portion 14.2 through the arcuate wall 86 throgh which the spoon can be extended by rectilinear movement to present the food to the invalid. Desirably, the aperture 92 shown in FIG. 4 has a concave lower edge 94 corresponding substantially to the transverse convexity of the bowl of the spoon 40 and a concave upper edge 96 at the upper side. The configuration of the aperture 92 is designed to remove excess food from the spoon as it travels forwardly from the receptacle to the invalid's mouth to prevent dripping. Additionally, to insure that excess food is returned to the receptacle, there is provided a scraper plate 98, FIG. 1B, for each receptacle 98*a*, 98*b*, 98*c*, containing an opening 100 which has a lower concave edge 102 corresponding in curvature to the bowl of the spoon and a concave upper edge 104. The scraper plate 98 removes excess food from the spoon before the latter enters the opening 92 so that it will be gravitationally returned into the lower trough portion 14.1 of the receptacle and, hence, less likelihood that it will be forced through the opening 92, The spoon in its orbital and rectilinear movement is raised to the level of the opening 100 in the scraper plate and then moved rectilinearly through the opening 100 and thereafter through the opening 92. After delivering the food to the invalid, the spoon is retracted through the openings 92 and 100 and returned to its at-rest position, FIGS. 1 and 2.

Figure 4:
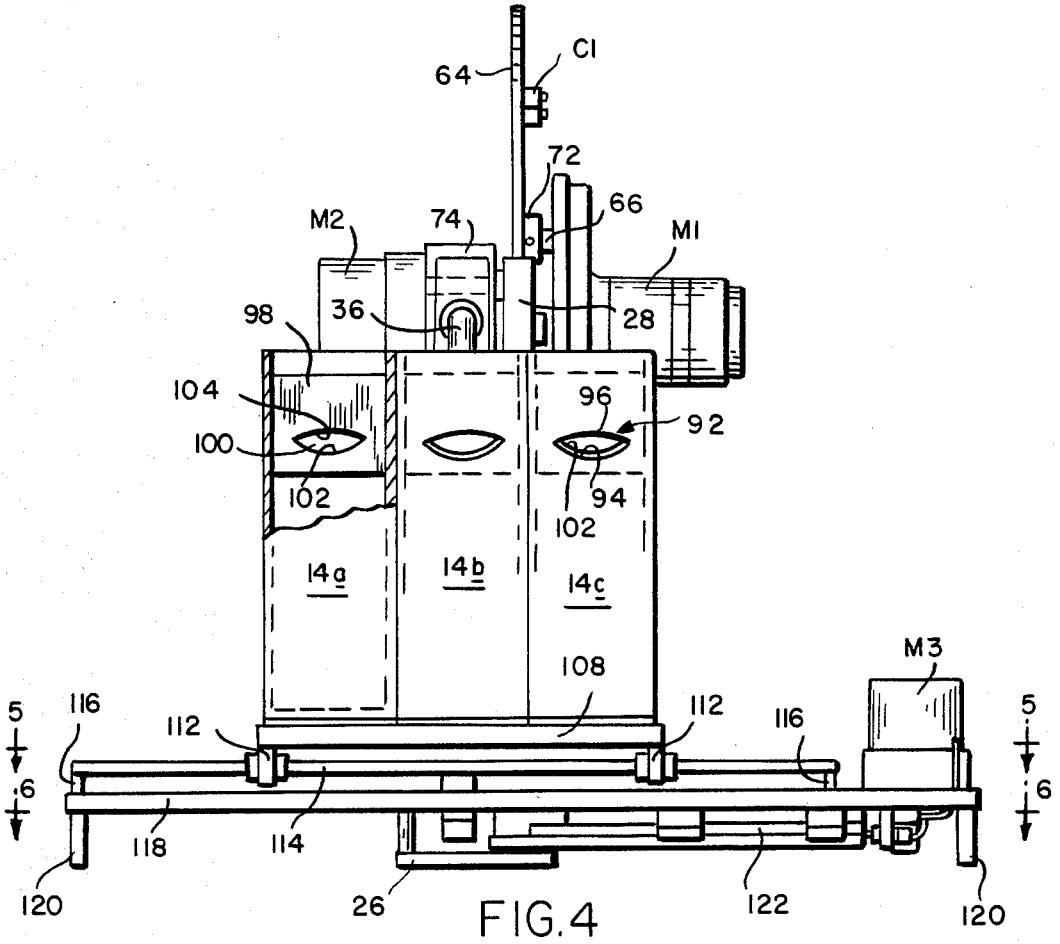
FIG. 4 is an elevation as seen from the right-hand end of FIGS. 1 and 3.
Figure 5:
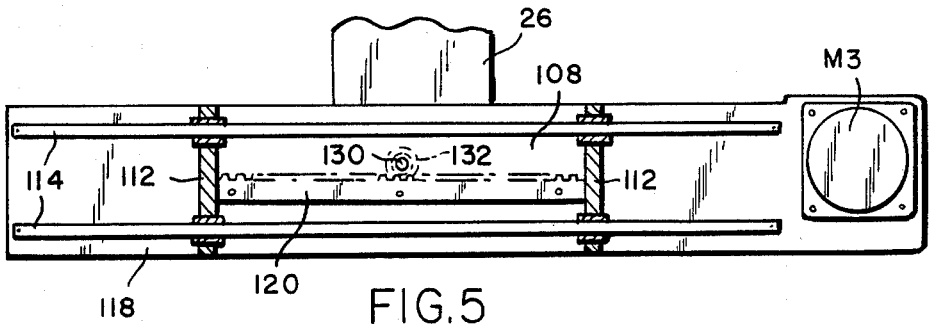
FIG. 5 is a plan view partly in section taken on the line 5—5 of FIG. 4.
Figure 6:
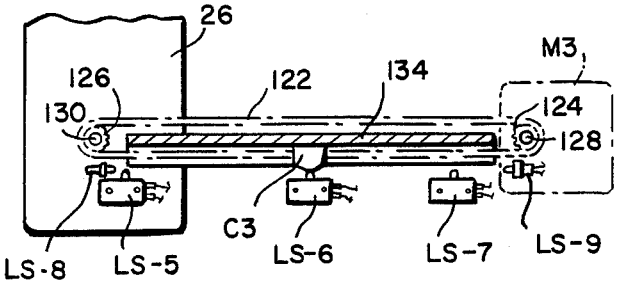
FIG. 6 is a plan view taken on the line 6—6 of FIG. 4.

As previously stated, one or more receptacles 14 are provided and each receptacle has fixed to its lower side as, for example, by welding, a flat slide plate 104 which defines flanges 106-106 and these are slidingly engaged within a carriage plate 108, FIGS. 1 and 4, provided with reentrant grooves 110-110 within which the flanges 106-106 are disposed. Each receptacle 14 is thus removably attached to the carriage plate providing for removing the receptacles from the carriage plate for washing, cleaning and filling with food. The carriage plate 108 is of such transverse length as to receive several receptacles, three being shown herein, denoted by the reference characters 14*a*, 14*b* and 14*c*, FIG. 3. the carriage plate 108 is supported transversely of the support 26 at the forward end thereof by a pair of transversely-spaced blocks 112-112, FIGS. 4 and 5, the latter, in turn, being slidably mounted on spaced, parallel, horizontal rods 114-114 supported by posts 116 on a bar 118. The bar 118 is, in turn, supported at its opposite end by legs 120. Thus, the carriage plate 108 and the receptacles mounted therein can be moved transversely with respect to the path of movement of the spoon. A link chain 122, FIG. 6, is mounted below the bar 118 on transversely-spaced sprockets 124 and 126. The sprocket 124 is fixed to a vertical shaft 128 which comprises the drive shaft of a motor M3 mounted on the bar 118 at the right-hand end thereof as shown in FIGS. 4 and 5. The sprocket 126 is fixed to a shaft 130 which extends upwardly through a suitable bearing in the bar 118 and has fixed to it a gear 132, FIG. 5, which meshes with a rack 120 fastened to the underside of the bar 118. The motor M3 is reversible so as to selectively traverse the carriage and, hence, the receptacles relative to the spoon in either direction. To guide the link chain 122 in its movement, there is provided a guide rail 134 fixed to the underside of the bar 118 between the runs of the chain.

Control of the apparatus is achieved by means of limit switches and appropriate circuitry and cycling may be automated or selective. In order to initiate a cycle of operation, a lever or its equivalent, not shown, is supported for movement in this particular instance to three different positions to select one of the three receptacles shown herein. When moved to a selecting position, the lever will actuate one of three limit switches LS5, LS6, and LS7, FIG. 6 and limit switch LS1, FIG. 2. There is a cam C3 fixed to a chain 122 and when the motor is actuated, it drives the chain and, hence, the cam C3 transversely relative to the switches LS5, LS6, and LS7. When the cam C3 reaches the selected switch, it actuates the switch to stop the carriage with the selected receptacle in alignment with the path of orbital movement of the spoon. There are reversible limit switches LS8 and LS9 at opposite ends of the travel of the carriage which reverse the direction of M-2 to reverse movement of the carriage to bring it to its selected position. When a selected receptacle reaches its position for receiving the spoon and is stopped at said position, the limit switch LS1, FIG. 2, is by-passed to start the motor M1 to commence a cycle of movement of the spoon. The motor M1 drives the disk 64 in rotation so as to move the spoon downwardly into the receptacle and then upwardly therefrom along an arc to scoop the food from the receptacle. When the spoon reaches the level of the scraper plate 98, a cam C1 on the disk 64, FIG. 2, actuates a switch LS2 to stop the motor M1 and energize the reversible motor M2, FIG. 1, to cause it to rotate in a direction to advance the spoon rectilinearly through the scraper plate 98 and through the opening 92 to present the spoon to the recipient.

A limit switch LS3, FIG. 1, actuated by extension of the traverse rod 38 to which the spoon is attached stops the motor M2 when the spoon is fully extended. A timer T, not shown, operation of which is initiated by actuation of the limit switch LS3, maintains the spoon in its extended position for a period of time, 0–50 seconds, to afford the recipient time to take the food into his mouth from the spoon and then reverses rotation of the motor M2 to retract the spoon. Desirably, approximately 5 seconds before the timer runs out, it actuates a switch in a circuit not shown herein to effect actuation of an alarm such as a buzzer and/or a light to warn the recipient that the spoon is about to be withdrawn. At the retracted position of the spoon, a switch LS4, FIG. 1, actuated by retraction of the rod 38, stops the motor M2 and reenergizes the motor M1 to rotate the disk 64 in a direction to bring the spoon back to the at-rest position, whereupon a cam C2, FIG. 2, on the disk actuates a switch LS1 to stop the motor M1 and, hence, terminate the cycle of operation.

The lever provided for actuating the switches LS5, LS6, LS7 and LS1 can be mounted on the chair or other support upon whichd the recipient rests in such a position as to be moved by the leg, body or head of the recipient. Means is also provided to program the movement of the switches LS5, LS6, LS7 and LS1 to actuate the apparatus where the recipient is incapable of effecting movement of the lever on his own behalf and/or where an attendant is not continually available. Circuitry for effecting automation is provided with conventional electrical components.

The apparatus thus described is of comparatively simple and compact construction, can be controlled with minimal participation on the part of the recipient, provides for selectivity of the food with which the recipient wishes to indulge himself, minimizes waste of food by spilling, maximizes cleaning and maintenance and is comparatively inexpensive with respect to similar devices.

It should be understood that the present disclosure is for the purpose of illustration only and includes all modifications or improvements which fall within the scope of the appended claims.

I claim:

1. Apparatus for feeding invalids comprising a spoon for presenting a portion of food to the invalid, a receptacle for containing food, means for supporting and moving the spoon from an at-rest position above the receptacle in a vertical orbit from said at-rest position above the receptacle into the receptacle along an arcuate path such that the spoon is plunged into the receptacle and then raised from the receptacle to a generally horizontal position and moved along a generally rectilinear path to present the portion of food contained by the spoon to the invalid and a scraper located in the path of said rectilinear movement of the spoon to remove excess food carried by the spoon before the spoon leaves the receptacle to return the excess food to the receptacle, said means being operable to retract the spoon following a predetermined interval to said initial at-rest position.

2. Apparatus according to claim 1 wherein said means comprises a rocker pivotally mounted intermediate its ends for pivotal movement about a horizontal axis, means connected to the rocker for effecting oscillation thereof relative to said pivot, a traverse rod reciprocally mounted to the rocker for rectilinear movement relative thereto, means connected to the traverse rod for effecting reciprocation thereof and means connecting the spoon to the traverse rod such that the spoon will partake of the oscillatory movement of the rocker and the rectiliner reciprocal movement of the traverse rod.

3. Apparatus according to claim 2 wherein the means for effecting oscillation of the rocker is a motor-driven disk rotatable about a horizontal axis to which an end of the rocker is pivotally connected at a radial distance from the axis of rotation thereof and the means for reciprocating the traverse rod is a rack fixed to the traverse rod, a pinion supported in mesh therewith and a motor, mounted to the rocker and drivably connected to the pinion.

4. Apparatus according to claim 2 wherein the rocker is a sleeve within which the traverse rod is slidably mounted.

5. Apparatus according to claim 3 wherein the traverse rod includes a rack, the rocker is a sleeve within which the traverse rod is slidably mounted containing an opening aligned with the rack and there is means mounting the motor to the rocker sleeve with the pinion positioned within the opening therein in mesh with the rack.

6. Apparatus according to claim 1 wherein there is a plow which repositions the food after the spoon passes through as a preparatory measure for the next cycle.

7. Apparatus according to claim 6 wherein the plow is removably fixed to the rocker for movement therewith.

8. Apparatus according to claim 1 wherein the receptacle has a retaining wall containing an opening through which the spoon is extended and retracted as it is moved along its generally rectangular path, and said opening is configured to permit passage of the spoon and to remove excess food from the spoon as the latter passes therethrough.

9. Apparatus according to claim 8 wherein said opening is defined by a concave lower edge contoured to the bowl of the spoon and a concave upper edge.

10. Apparatus according to claim 8 wherein there is a scraper positioned rearwardly of the retaining wall with respect to the forward movement of the spoon containing an opening aligned with the opening in the retaining wall through which the spoon is extended prior to extension through the opening in the retaining wall, said scraper operating to strip excess food from the spoon.

11. Apparatus according to claim 6 wherein the receptacle has spaced, parallel side walls and the plow is a flat plate supported below the bowl of the spoon and transversely thereof corresponding in transverse length to substantially the distance between the side walls of the receptacle.

12. Apparatus according to claim 1 comprising a carriage for mounting two or more receptacles for movement transversely of the spoon.

13. Apparatus according to claim 12 wherein the carriage embodies means for removably attaching the receptacles thereto.

14. Apparatus according to claim 12 wherein the carriage contains at its longitudinal side reentrant grooves and the receptacles have at their bottoms spaced flanges slidably engaged with said grooves.

15. Apparatus according to claim 12 wherein there is rack and pinion means for traversing the carriage and a motor-driven sprocket drivably connecting it to the pinion.

16. Apparatus according to claim 12 wherein there is control means for selectively traversing the carriage to position a selected receptacle in the path of orbital movement of the spoon and control means for cycling orbital movement of the spoon.

17. Apparatus according to claim 16 wherein there is means inhibiting operation of the latter means for cycling movement of the spoon until a selected receptacle has been moved into a position to receive the spoon.

18. Apparatus according to claim 3 wherein there is control means for cycling orbital movement of the spoon comprising a starting switch for initiating rotation of the disk to move the spoon along an orbital path such as to move the spoon directly into the receptacle and then raise it to the level of the opening therein, a cam-operated switch for stopping the disk when the spoon reaches the level of said opening and initiating rectilinear movement of the spoon, a timer-operated switch for effecting retraction of the spoon following a predetermined interval, a limit switch for terminating retraction of the spoon and resuming orbital movement of the spoon and a cam-operated switch for stopping the orbital movement of the spoon when it returns to its at-rest position.

19. Apparatus according to claim 18 wherein said cams are fixed to the disk for rotation therewith in a path to actuate the switches.

* * * * *

UNITED STATES PATENT AND TRADEMARK OFFICE

CERTIFICATE OF CORRECTION

PATENT NO. : 4,522,543

DATED : June 11, 1985

INVENTOR(S) : Eric Robinson

It is certified that error appears in the above-identified patent and that said Letters Patent is hereby corrected as shown below:

Col. 1, l. 7: change "3,317,661" to --3,317,061--

Col. 1, l. 65: change "motor-drivien" to --motor-driven--

Col. 2, l. 11: change "receptable" to --receptacle--

Col. 3, l. 27: change "receptables" to --receptacles--

Col. 3, l. 54: change "throgh" to --through--

Col. 5, l. 36: change "whichd" to --which--

Signed and Sealed this

*Tenth* Day of *December 1985*

[SEAL]

*Attest:*

DONALD J. QUIGG

*Attesting Officer*

*Commissioner of Patents and Trademarks*